US010330431B1

(12) United States Patent
West

(10) Patent No.: US 10,330,431 B1
(45) Date of Patent: Jun. 25, 2019

(54) SELF DEFENSE TOOL

(71) Applicant: James V. West, West Caldwell, NJ (US)

(72) Inventor: James V. West, West Caldwell, NJ (US)

( * ) Notice: Subject to any disclaimer, the term of this patent is extended or adjusted under 35 U.S.C. 154(b) by 67 days.

(21) Appl. No.: 15/606,061

(22) Filed: May 26, 2017

Related U.S. Application Data

(60) Provisional application No. 62/341,968, filed on May 26, 2016.

(51) Int. Cl.

| | |
|---|---|
| ***F41B 13/00*** | (2006.01) |
| ***B26B 29/02*** | (2006.01) |
| ***B26B 3/00*** | (2006.01) |
| ***A45F 5/00*** | (2006.01) |
| ***F41B 13/08*** | (2006.01) |
| ***B26B 5/00*** | (2006.01) |
| ***A45F 5/02*** | (2006.01) |

(52) U.S. Cl.
CPC ..... *F41B 13/08* (2013.01); *A45F 5/021* (2013.01); *B26B 5/00* (2013.01); *B26B 29/025* (2013.01)

(58) Field of Classification Search
CPC ..... F41B 13/08; A45F 5/021; B26B 29/025; B26B 5/00; B26B 3/00
USPC ..... 30/299
See application file for complete search history.

(56) References Cited

U.S. PATENT DOCUMENTS

| | | | | |
|---|---|---|---|---|
| 2,421,339 | A * | 5/1947 | Leger | F41B 13/08 16/430 |
| 2,551,899 | A * | 5/1951 | Pfeifer | A01D 1/04 30/299 |
| 2,587,336 | A * | 2/1952 | Larson | A01D 1/04 30/299 |
| 5,211,322 | A * | 5/1993 | Nealy | B26B 29/025 224/230 |
| 5,704,129 | A * | 1/1998 | Glesser | B26B 1/02 30/123 |
| 5,724,739 | A * | 3/1998 | Hutton | B26B 3/00 30/340 |
| 6,725,545 | B2 * | 4/2004 | Frank | B26B 1/04 30/123 |
| D495,772 | S * | 9/2004 | Hibben | D22/118 |
| 7,940,510 | B2 * | 5/2011 | Krudo | B26B 11/00 361/232 |
| 9,095,202 | B1 * | 8/2015 | Vanheteren | A45F 5/021 |
| 9,631,892 | B1 * | 4/2017 | Salvitti | F41B 13/08 |
| 2011/0010949 | A1 * | 1/2011 | Garrison | B26B 3/04 30/279.2 |

(Continued)

*Primary Examiner* — Hwei-Siu C Payer
(74) *Attorney, Agent, or Firm* — Fox Rothschild LLP

(57) ABSTRACT

A self-defense tool having a blade that is designed primarily for self-defense is described. The design is intended to eliminate intent to kill on the part of the user when used in defense of an attack. The tool cannot easily be used as an offensive weapon. Thus, when used properly, the tool is geared to take the intent to kill away from the user. The tool is designed to hit the pressure points or places of an attacker and give time for the user to make a critical decision to run or defend. The sharpened blade portion has a reverse cut that is intended to cut more as an attacker pulls away than when the sharpened blade portion is thrust forward. The design minimizes the probability of self-injury by the tool, while maximizing the ability to defend the user from the attacker.

20 Claims, 6 Drawing Sheets

(56) References Cited

U.S. PATENT DOCUMENTS

2015/0224652 A1* 8/2015 Irvin ..... B26B 3/00
30/155

* cited by examiner

SELF DEFENSE TOOL

CROSS REFERENCE TO RELATED APPLICATIONS

This application claims priority to U.S. Provisional Application Ser. No. 62/341,968 filed May 26, 2016, which is incorporated herein by reference as if fully disclosed herein.

FIELD OF THE DISCLOSURE

The field of the present disclosure is in the area of self-defense tools.

BACKGROUND

Numerous self-defense tools have been used to provide peace-of-mind to the user. Conventional self-defense tools include pepper spray, Tasers, and the like. These tools provide non-lethal means to allow a victim of an attack time to get away from his or her assailant. However, they can be difficult to use in practice. For example, pepper spray is compact and easy to carry, and when used properly, can prove effective at briefly debilitating an assailant. Pepper spray canisters, however, are not conducive to panicked use, as would commonly be expected in a surprise attack. Tasers share similar problems. Weapons such as knives and firearms are too easily used offensively and may be subject to additional regulation. They also present a strong risk of self-injury in a panicked situation. Thus, a need exists for a self-defense tool that is designed for protection, allows safe and effective operation in surprise and/or panicked conditions, and provides for a quick shock or debilitating injury to the assailant to allow the victim to remove themselves from danger.

SUMMARY

Disclosed is a self-defense tool having a blade that is designed primarily for self-defense. The design is intended to eliminate intent to kill on the part of the user when used in defense of an attack. The tool cannot easily be used as an offensive weapon. Thus, when used properly, it is geared to take the intent to kill away from user. The tool is designed to hit the pressure points or places of an attacker and give time for the user to make a critical decision to run or defend. The sharpened blade portion has a reverse cut that is intended to cut more as an attacker pulls away than when the sharpened blade portion is thrust forward. The design minimizes the probability of self-injury by the tool, while maximizing the ability to defend the user from the attacker.

In an embodiment, a self-defense tool may include a grip portion that has a central longitudinal axis, and a blade portion associated to the grip portion forming a first angle between 40 and 50 degrees from a perpendicular line extending from the central longitudinal axis. The blade portion may include a blunt outer portion that curves to a tip and a blunt inner portion. The self-defense tool may also include a sharpened portion positioned between the tip and the blunt inner portion, the sharpened portion extends in a straight line that forms a second angle with a horizontal line perpendicular to the central vertical axis of the grip portion, the second angle measuring between 40 and 50 degrees. The sharpened portion may be between 1 inches and 3 inches long, preferably about 2 inches.

In other embodiments, the first angle may be between 45 and 48 degrees, and the second angle may be between 42 and 45 degrees. In other embodiments, the first angle may be between 46 and 47 degrees, and the second angle may be between 43 and 44 degrees. In some embodiments, the first and second angles may be substantially complementary.

Optionally, the grip portion may be capable of being used ambidextrously and is substantially linear and straight. The blunt inner portion may include one or more indents and, in some embodiments, the indents may be smoothly curved in shape. The indents may have a radius of curvature between 0.5 and 1 inches. In some embodiments, the blunt inner portion includes four indents. In some embodiments, three of the indents each may have a radius of curvature between 0.6 and 0.7 inches, and a fourth indent may have a radius of curvature between 0.9 and 1 inches. In some embodiments, the fourth indent is positioned proximate to the sharpened portion.

Optionally, the blade portion and the grip portion may be detachable. The blade portion may be attached to the grip portion at a first end of the grip portion and the grip portion may include a pointed end distal to the first end. The pointed end may have a pyramidal shape and in one embodiment its length may vary from as small as about 20 mm to as large as about 40 mm, more preferably about 25 mm to about 35 mm.

Optionally, the self-defense tool may also include a holster that may be shaped to accommodate the blade portion and completely covers at least the sharpened portion. The holster may include a clip that facilitates attachment to a belt and the clip may be configured to hold the self-defense tool so that the grip portion is in a substantially horizontal position. Alternatively, the clip may be configured to hold the self-defense tool so that the grip portion is held at an angle of between 6 and 10 degrees relative to the clip, and may be held at an angle around 8 degrees.

BRIEF DESCRIPTION OF THE DRAWINGS

The various aspects, features and embodiments of the self-defense tool and holster as disclosed herein will be better understood when read in conjunction with the drawings provided. Embodiments are provided in the drawings for the purposes of illustrating aspects, features and/or various embodiments of the self-dense tool and holster, but the claims should not be limited to the precise arrangement, structures, subassemblies, features, embodiments, aspects, and devices shown, and the arrangements, structures, subassemblies, features, embodiments, aspects, and devices shown may be used singularly or in combination with other arrangements, structures, subassemblies, features, embodiments, aspects, and devices. The drawings are not necessarily to scale and are not in any way intended to limit the scope of the claims, but merely are presented to illustrate and describe various embodiments, aspects and features of the self-defense tool and holster to one of ordinary skill in the art.

FIG. 2A shows a side view of an exemplary embodiment of a blade portion, while FIG. 2B shows a front view of the blade portion of FIG. 2A.

FIG. 3A shows a first side view of an exemplary embodiment of a grip portion, FIG. 3B shows a front view of the grip portion of FIG. 3A, FIG. 3C shows the other side view of the grip portion of FIG. 3A, and FIG. 3D shows a top view of the grip portion of FIG. 3A.

FIG. 5A shows a front view of an exemplary embodiment of a self-defense tool, FIG. 5B shows a rear view of the self-defense tool of FIG. 5A, and FIG. 5C shows a top view of the self-defense tool of FIG. 5A.

FIG. 6A shows a first side view of an exemplary embodiment of a self-defense tool in a holster, FIG. 6B shows a top view of the self-defense tool and holster of FIG. 6A, FIG. 6C shows the other side view of the self-defense tool and holster of FIG. 6A, FIG. 6D shows a perspective side view of the self-defense tool and holster of FIG. 6A, and FIG. 6E shows the perspective side view of the self-defense tool and holster of FIG. 6E.

DETAILED DESCRIPTION

Figure 1B:
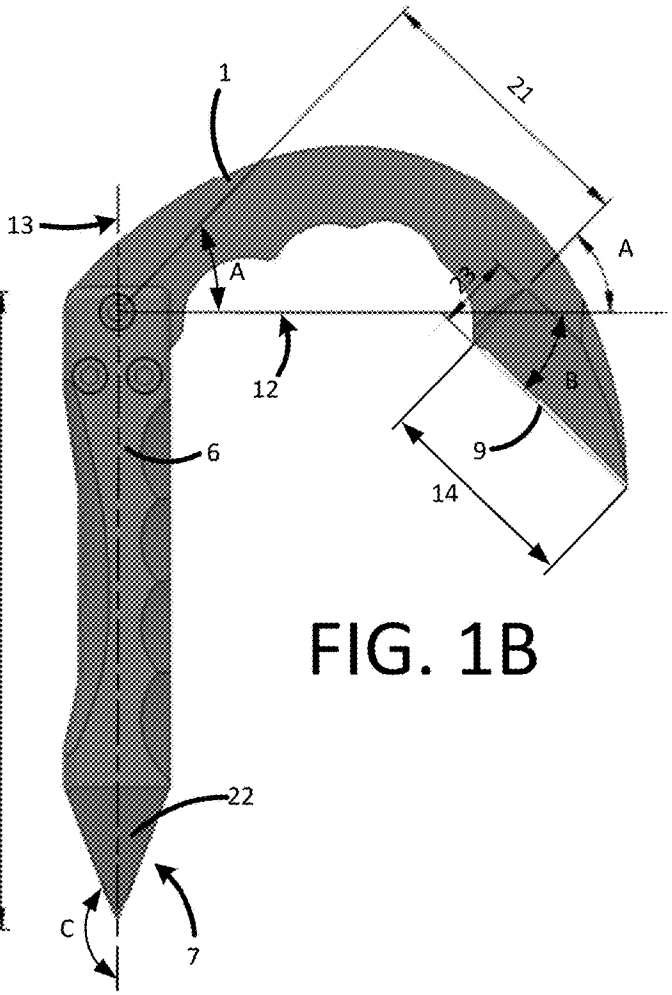
FIGS. 1A and 1B show side views of an exemplary embodiment of a self-defense tool.

In the following detailed description, numerous details are set forth in order to provide an understanding of the self-defense tool and holster, and their method of operation and use. However, it will be understood by those skilled in the art that the different and numerous embodiments of the self-defense tool and holster, their method of operation and use may be practiced without these specific details, and the claims and invention should not be limited to the embodiments, subassemblies, or the specified features or details specifically described and shown herein. The description provided herein is directed to one of ordinary skill in the art and in circumstances, well-known methods, procedures, manufacturing techniques, components, and assemblies have not been described in detail so as not to obscure other aspects, or features of the self-defense tool and holster.

Accordingly, it will be understood that the components, aspects, features, elements, and subassemblies of the embodiments, as generally described and illustrated in the figures herein, can be arranged and designed in a variety of different configurations in addition to the described embodiments. It is to be understood that the self-defense tool and holster may be used with many additions, substitutions, or modifications of form, structure, arrangement, proportions, materials, and components, which may be particularly adapted to specific environments and operative requirements without departing from the spirit and scope of the invention. The following descriptions are intended only by way of example, and simply illustrate certain selected embodiments of a self-defense tool and holster. For example, while the self-defense tool and holster are shown and described in examples with particular reference to its use as a self-defense tool to protect against an attack, it should be understood that the self-defense tool and holster, and aspects thereof may have other applications as well. The claims appended hereto will set forth the claimed invention and should be broadly construed to cover a self-defense tool and/or holster, unless otherwise clearly indicated to be more narrowly construed to exclude embodiments, elements and/or features of the self-defense tool and/or holster.

Throughout the present application, reference numbers are used to indicate a generic element, mechanism, assembly, or feature of the self-defense tool and/or holster. The same reference number may be used to indicate elements, mechanisms, assemblies, or features that are not identical in form, shape, structure, etc., yet which provide similar functions or benefits. Additional reference characters (such as letters, primes, or superscripts, as opposed to numbers) may be used to differentiate similar elements or features from one another. It should be understood that for ease of description the disclosure does not always refer to or list all the components of the self-defense tool, and/or holster, and that a singular reference to an element, member, or structure, e.g., a singular reference to an indentation, may be a reference to one or more such elements, unless the context indicates otherwise.

In the following description of various embodiments of the self-defense tool, and/or holster, it will be appreciated that all directional references (e.g., proximal, distal, upper, lower, upward, downward, left, right, lateral, longitudinal, front, rear, back, top, bottom, above, below, vertical, horizontal, radial, axial, interior, exterior, clockwise, and counterclockwise) are only used for identification purposes to aid the reader's understanding of the present disclosure unless indicated otherwise in the claims, and do not create limitations, particularly as to the position, orientation, or use in this disclosure. Features described with respect to one embodiment typically may be applied to another embodiment, whether or not explicitly indicated.

Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

Embodiments of the present invention are not limited to the particular methodology, uses, and applications described herein, as these may vary. It is also to be understood that the terminology used herein is used for the purpose of describing particular embodiments only, and is not intended to limit the scope of the embodiments of the invention. It must be noted that as used herein and in the appended claims, the singular forms "a," "an," and "the" include the plural reference unless the context clearly dictates otherwise. Thus, for example, a reference to "an element" is a reference to one or more elements, and includes equivalents thereof known to those skilled in the art. Similarly, for another example, a reference to "a step" or "a means" is a reference to one or more steps or means and may include sub-steps or subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Unless defined otherwise, all technical and scientific terms used herein have the same meanings as commonly understood by one of ordinary skill in the art to which this invention belongs. Preferred methods, techniques, devices and materials are described although any methods, techniques, devices, or materials similar or equivalent to those described may be used in the practice or testing of the present invention.

All patents and other publications discussed are incorporated herein by reference for the purpose of describing and disclosing, for example, the methodologies described in such publications that might be useful in connection with the present invention. These publications are provided solely for their disclosure prior to the filing date of the present application. Nothing in this regard should be construed as an admission that the inventors are not entitled to antedate or otherwise remove any such publication or patent as prior art for any reason.

Figure 1A:
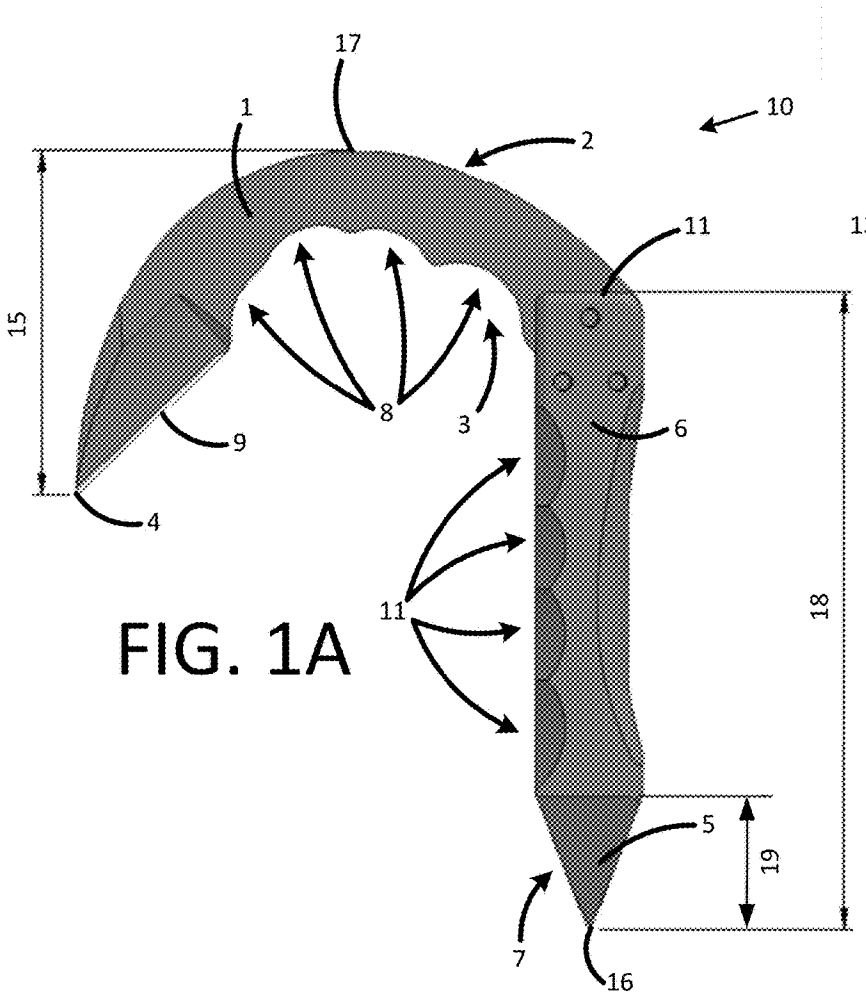

With reference to FIGS. 1A-B, self-defense tool 10 includes (with reference to FIG. 1A) a curved blade portion 1 and a hilt or grip portion 6. Curved blade portion 1 includes a blunt outer portion 2, a blunt inner portion 3, a tip 4, opposite connection end 11, and a sharpened portion 9. Blade portion 1 may be connected to or integral with the grip portion 6 at the connection end 11 of the blade portion 1. The curved blunt outer portion 2 extends from hilt or grip portion 6 to tip 4. The curved blade portion 1 has a curved outer portion 2 that may be arcuate, parabolic, elliptical, or other rounded or curved shape. The curved outer blunt portion 2 preferably is designed to resist and inhibit a user from puncturing or cutting themselves. Sharpened portion 9 extends from blunt inner portion 3 to tip 4. The sharpened portion 9 may be designed as, for example, a reverse cut blade that is designed to cut more when the attacker is pulling away from the user, than when the sharpened portion is thrust forward or at an attacker. Sharpened blade portion 9 preferably is straight and in one embodiment may have a length 14 ranging from between about 1.0 to about 3.0 inches, more preferably about 1.5 to about 2.5 inches. Sharpened portion 9 in one embodiment may have a length 14 that ranges from about 1.75 to about 2.25 inches. Others lengths 14 for sharpened portion 9 are contemplated.

The curved blunt inner portion 3 may include a number of indents or notches 8. Indents 8 may be rounded, smooth and be sized for use or to be held by a user as finger grips. While four indents 8 have been shown it will be appreciated that more or less indents 8 may be used. It is further contemplated that the indents 8 on the inner blade portion 3 may be rubberized or us other constructions and materials to increase the ability to grip the blade portion 1 by the user. The blade portion 1 preferably is formed of steel although other materials of construction are contemplated. The blade portion preferably has a thickness 27 (shown in FIG. 2B) in one embodiment of as little as about 1 mm to as much as about 5 mm, more preferably about 1.5 mm to about 2.5 mm.

The grip or handle portion 6 preferably is designed to be ambidextrous. The grip portion 6 preferably is substantially straight and has a longitudinal axis 13. The grip portion 6 may range in length 18 from as little as about 10 cm to as much as about 18 cm, more preferably about 12 cm to about 16 cm. In one embodiment, grip portion 6 has a length 18 of about 15 cm. Other shapes and sizes for the grip portion 6 are contemplated. Grip portion 6 may be formed of steel although other materials of construction are contemplated, including having rubberized portions or covering to increase grip, or other constructions to facilitate gripping and using the tool 10.

Grip portion 6 includes an end 5 that preferably is pointed and includes a number of edges 7. The end 5 may be, for example, pyramidal in shape and come to a sharp point 16. The end 5 may have any number of edges 7 and a corresponding number of sides 22. The edges 7 may be sharp and designed to cut into body tissue of an attacker. In one embodiment, as shown in FIG. 1B the angle C formed between the longitudinal axis 13 of the grip portion 6 and the edge 7 (or side surface 22) is as little as about 135 degrees to as much as 165 degrees, more preferably between about 150 and about 160 degrees. In one embodiment, angle C is between about 155 and about 160 degrees. The end 5 alternatively may be blunt. The optional pointed end 5 in preferred form may have a length 19 as small as about 20 mm to about 40 mm, more preferably about 25 mm to about 35 mm. In one embodiment, length 19 is about 30 mm.

The handle or grip portion 6 may include grip indents 11 to facilitate gripping the handle so the tool 10 does not slip off the user's hand. In the event the user's hand slides off the grip portion 6, the pointed end 5 may have a lip portion to catch the tool, and/or a bevel to protect the user's hands from injury.

The tool 10 may be deployed in a number of ways. For example, it can be held by the blunt portion 2 to mimic a handgun in an attempt to cause the attacker to pause. It can be used as a blocker to block attacks by someone wielding a knife or some other hand weapon. The edges 7 may be sharp to provide additional defensive protection.

The tool 10 may be a single molded piece or may include two detachable/re-attachable sections, for example, the blade portion 1 and grip portion 6, and may be used as two separate weapons. The sections may comprise interchangeable parts, for example, the blade portion 1 may be replaceable, may have parts that are rubberized and/or dulled replacement metal alloy for training purposes, and the like. The pointed end 5 of the grip 6 may also be replaceable.

The tool 10 is designed for natural body movement if the user is surprised and is designed to minimize injury to user. For example, if the user is attacked by a third party when walking down the street, the general instinct is to pull back and put hands up. When holding the tool, the user will be protected from a number of attack angles.

The tool 10 also has military applications. Law enforcement, fire fighters and combatants who work in an urban environment or deployment in a war zone (close quarters and room clearing) are susceptible to losing their handgun and often get killed and/or injured by their own weapon. Tool 10 is an option for additional protection. It can be handled in a holster or in the open and it does not fall under most, if not all, legal guidelines of an edged weapon due to the small size of the sharpened blade portion 9. A different type of steel may be used for commercial applications, with military applications being made of a harder steel. The weight may be controlled by boring out some of the handle. When a soldier has been walking for miles, in a firefight, this is designed to be held easily, as a backup to protect the user.

In one embodiment, the grip and blade portion may be separable pieces and replacement training parts can be a part of the design. In another embodiment, the tool may be constructed out of one single piece of material. The disclosure is not limited in this regard.

Referring now to FIG. 1B, which shows an opposite side view of FIG. 1A, two angles are shown, angles A and B in relation to a perpendicular line 12 extending from the longitudinal axis 13 of the grip portion 6. Angle A corresponds to the angle at which the blade portion 1 extends from the perpendicular line 12. Angle A preferably is as small as about 40 degrees and as large as about 50 degrees from the perpendicular line 12. Angle A may be, for example, between about 45 and about 48 degrees. Angle A may also be, for example, between 46 and 47 degrees. In one embodiment, angle A may also be, for example, exactly or substantially 46.5 degrees. Angle B corresponds to the angle at which the sharpened portion 9 extends with respect to the perpendicular line 12. Angle B preferably is as small as about 40 degrees and as large as about 50 degrees. Angle B may be, for example, between about 42 and about 45 degrees. Angle B may also be, for example, between 43 and 44 degrees. In one embodiment, angle B may also be, for example, exactly 43.5 degrees.

The blade portion 1 as shown in FIG. 1A has a vertical height 15 that extends from tip 4 to apex 17 of the outer blade portion 2. Vertical height 15 in one embodiment preferably is as small as about 50 mm to as large as about 110 mm. The height 15, for example, may be between about 70 mm and 90 mm, more preferably, for example, about 75 mm to about 85 mm. The blade portion 1 as shown in FIG. 1A may have tip 4 extend a lateral distance 20 from the grip portion 6. Lateral distance 20, in one embodiment, may be as little as about 90 cm to as much as about 130 cm. More preferably, lateral distance 20 is about 100 to about 120, more preferably about 105 to about 115. Dimension 21 as shown in FIG. 1B, in one embodiment, ranges from as little as about 50 mm to as much as about 90 mm. More preferably dimension 21 ranges from about 80 mm to about 60 mm, more preferably from about 70 mm to about 65 mm. Dimension 23 as shown in FIG. 1B, in one embodiment, ranges from as little as about 5 mm to as large as about 30 mm. More preferably, dimension 23 ranges from about 10 mm to about 25 mm, more preferably about 15 mm to about 20 mm. Other values for dimensions 15, 20, 21 and 23 are contemplated.

Figure 2B:
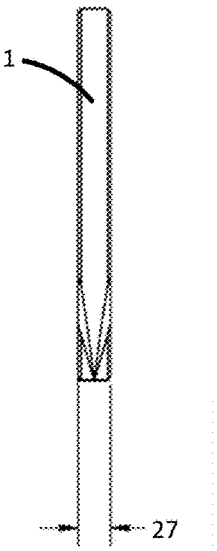
FIGS. 2A and 2B.
Figure 2A:
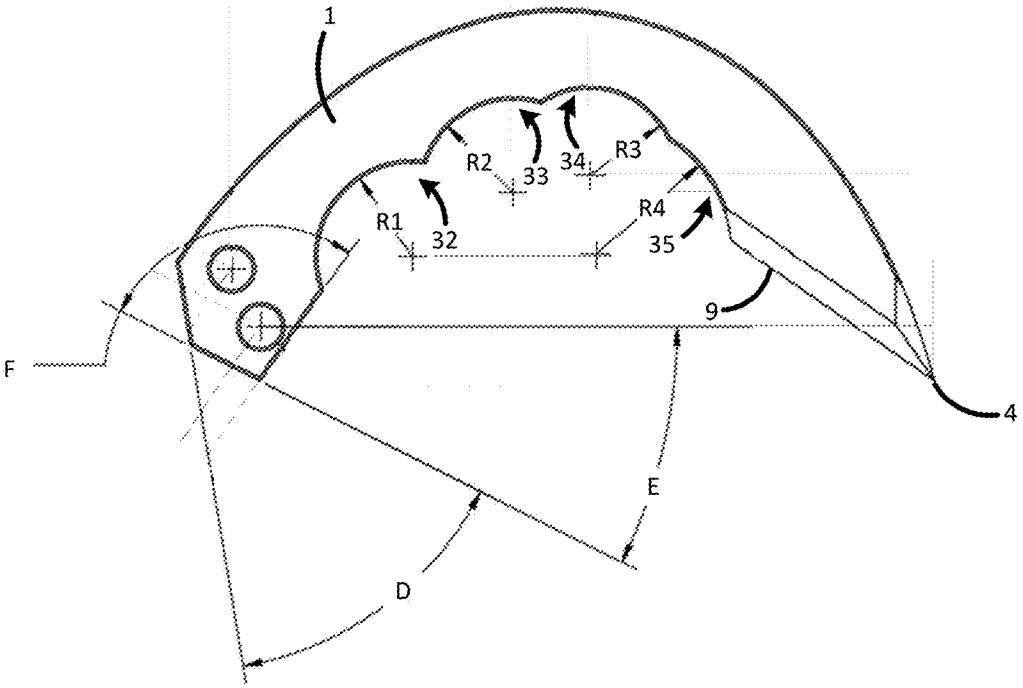
Figure 3D:
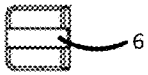
FIGS. 3A, 3B, 3C and 3D.
Figure 3A:
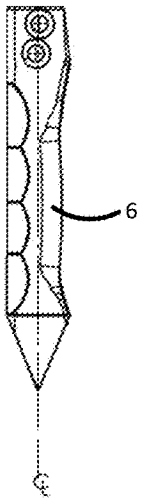
Figure 3B:
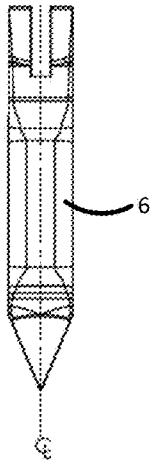
Figure 3C:
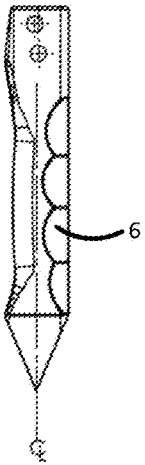
Figure 4A:
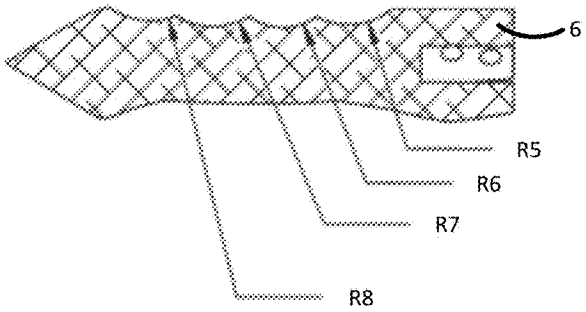
FIGS. 4A and 4B show side cross sectional views of an exemplary embodiment of a grip portion.
Figure 4B:
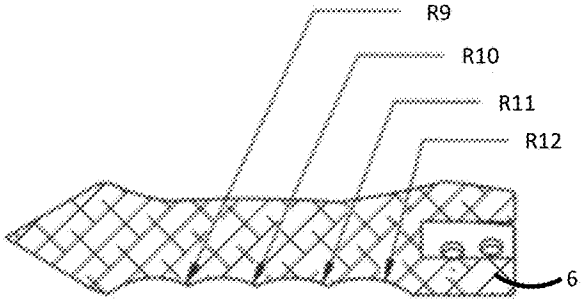
Figure 5C:
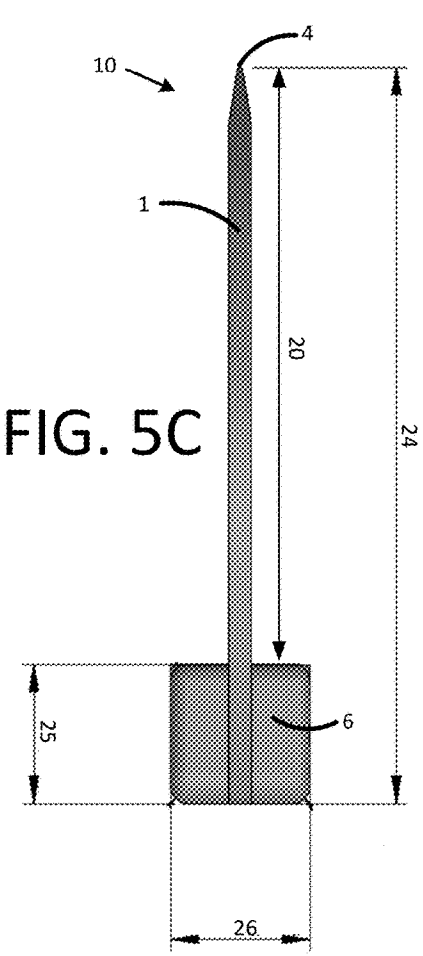
FIGS. 5A, 5B and 5C.
Figure 5B:
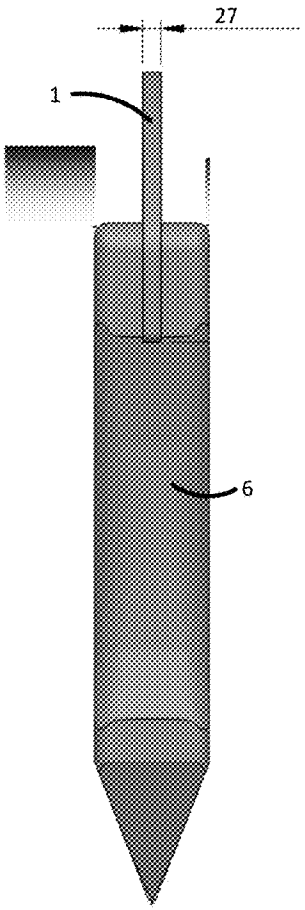
Figure 5A:
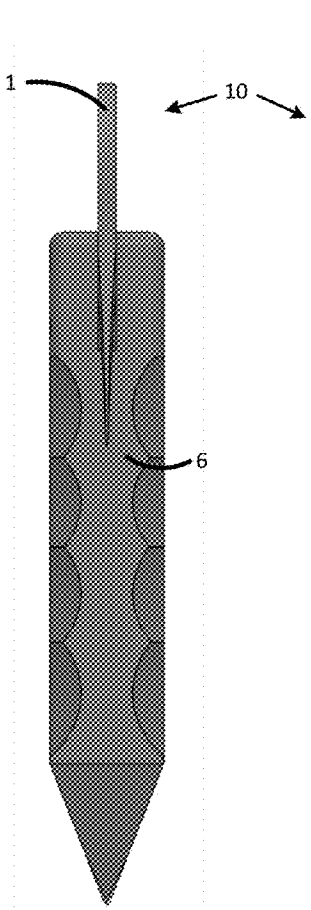
Figure 6A:
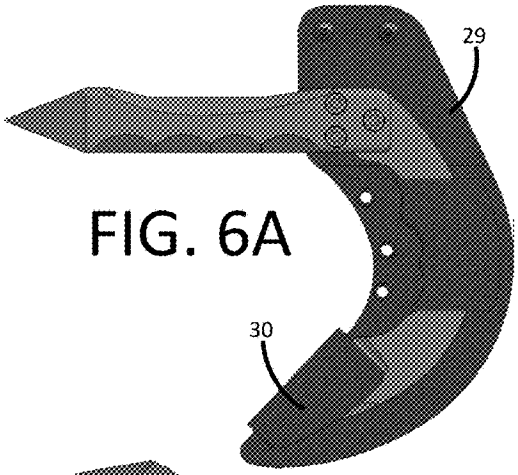
FIGS. 6A, 6B, 6C, 6D and 6E.
Figure 6C:
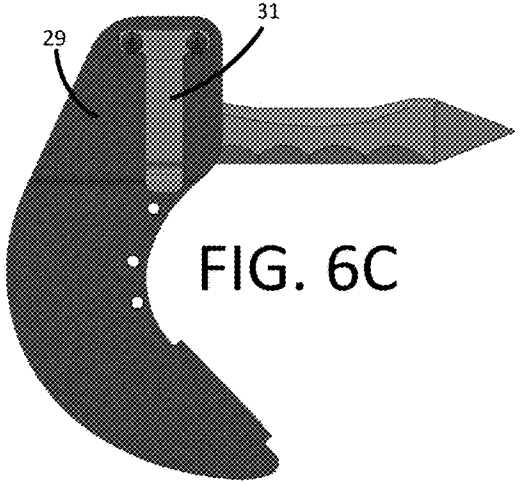
Figure 6B:
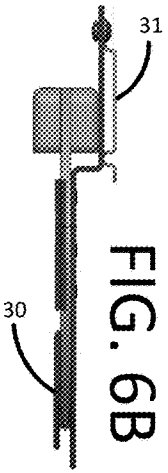
Figure 6D:
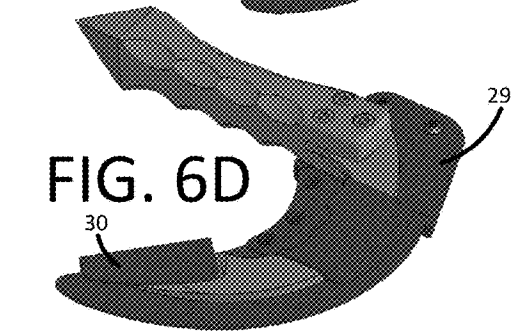
Figure 6E:
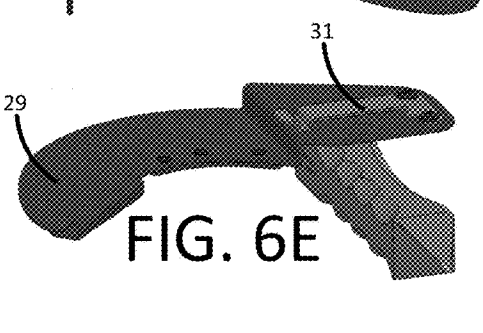

With reference to FIG. 2A, showing example measurements for the blade portion 1, the angles D, E, and F are selected are selected to enable maximum safety for the user and to eliminate the possibility of self-injury when the tool is held and used properly. In an embodiment, as shown in FIG. 2A, angle D is about 54°, angle E is about 27°, and angle F is about 98°. These angles may be adjusted without departing from the overall design. FIG. 2A also shows exemplary measurements for the indents 8 in the blunt inner portion 3. Indents 32, 33, 34, 35 are also shown on blade portion 1. All indents may have a radius of curvature R1-R4, for example between 0.5 and 1 inch. Indents 32, 33, 34 may preferably have a radius of curvature R1-R3, for example, between 0.6 and 0.7 inches. Indent 35, proximate to the sharpened portion 9 and the tip 4 of the blade portion 1, may preferably be larger and have a radius of curvature R4 between 0.9 and 1 inch. FIG. 2B shows the thickness 27 of the blade portion 1. FIGS. 3A-D shows exemplary views for the grip portion 6. FIGS. 4A-B show two cross sections cut through the center line and diagonal through grip portion 6. FIGS. 4A and 4B show a plurality of finger indents that are present in the grip portion 6. Each indent has a radius of curvature, for example, R5-R12. These radii of curvature may range from 0.5 through 1 inch. They may be selected based on a typical proportional size of human fingers FIGS. 5A-C show various views of the tool 10 and portions thereof. The self-defense tool 10 includes grip portion 6 and the blade portion 1. The blade tip-to-grip lateral dimension 20, as noted above, may be as little as 90 cm and as much as 130 cm. The lateral dimension 25 of the grip portion 6 may be about 25 cm, or 1 inch, though other values for this dimension are contemplated. The overall tool lateral dimension 24, corresponds to the sum of blade tip-to-grip lateral dimension 20 and grip lateral dimension 25. Preferably, the grip width dimension 26 may be about 25 cm, or 1 inch, though other values for this dimension are contemplated.

FIGS. 6A-E also show views of a self-defense tool that also include a holster 29. The holster 29 can be of any suitable design without departing from the disclosure. A cover portion 30 of the holster 29 preferably covers the sharpened portion 9. The holster 29 may also include a clip 31 that is adapted to attach holster 29 to a belt or other article of clothing worn by a user of the self-defense tool 10. The clip 31 may be adapted to hold the self-defense tool 10 so that the grip portion 6 is held horizontally or so that the grip portion 6 is held vertically. The clip 31 may also be adapted to hold the self-defense tool 10 so that the grip portion 6 is held at any angle to a vertical line, including angles between about 6 and about 10 degrees, for example, about 8 degrees.

Proportions shown in any figures accompanying this disclosure are for illustration purposes only and may also be adjusted without departing from the spirit of the invention.

The tool 10 can be used to defensively protect against attack. Should a would-be attacker move toward the user, holding the tool 10 with the pointed end 5 out allows the user to jab the attacker with the pointed end 5. The attacker would likely recoil instinctively and allow the user to run away or position for further defense. For example, the tool 10 can be held with the curved blade portion 1 out to allow the user to hook the attacker. Because of the reverse cut on the blade portion 1, the attacker would only be sliced if they attempt to pull away. The distinctive wounds left by the tool 10 also enable easy identification of the attacker for prosecution.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The foregoing description has broad application. It should be appreciated that the concepts disclosed herein may apply to many types of self-defense tools and/or holsters, in addition to those described and depicted herein. For example, the concepts may apply equally to another holster, or blade portion or handle assembly. The discussion of any embodiment is meant only to be explanatory and is not intended to suggest that the scope of the disclosure, including the claims, is limited to these embodiments.

Those skilled in the art will recognize that the self-defense-tool and/or holster has many applications, may be implemented in various manners and, as such is not to be limited by the foregoing embodiments and examples. Any number of the features of the different embodiments described herein may be combined into a single embodiment. The locations and sizes of particular elements, for example, the indentations, the sharpened portion, the blunt portions etc., may be altered. Alternate embodiments are possible that have features in addition to those described herein or may have less than all the features described. Functionality may also be, in whole or in part, distributed among multiple components, in manners now known or to become known.

It will be appreciated by those skilled in the art that changes could be made to the embodiments described above without departing from the broad inventive concept. It is understood, therefore, that this invention is not limited to the particular embodiments disclosed, but it is intended to cover modifications within the spirit and scope of the invention. While fundamental features have been shown and described in exemplary embodiments, it will be understood that omissions, substitutions, and changes in the form and details of the disclosed embodiments of the self-defense tool and/or holster may be made by those skilled in the art without departing from the spirit of the invention. Moreover, the scope of the invention covers conventionally known, and future-developed variations and modifications to the components described herein as would be understood by those skilled in the art.

In the claims, the term "comprises/comprising" does not exclude the presence of other elements, features, or steps. Furthermore, although individually listed, a plurality of means, elements, or method steps may be implemented by, e.g., a single unit, element, or piece. Additionally, although individual features may be included in different claims, these may advantageously be combined, and their inclusion individually in different claims does not imply that a combination of features is not feasible and/or advantageous. In addition, singular references do not exclude a plurality. The terms "a", "an", "first", "second", etc., do not exclude a plurality. Reference signs or characters in the disclosure and/or claims are provided merely as a clarifying example and shall not be construed as limiting the scope of the claims in any way.

Accordingly, while illustrative embodiments of the disclosure have been described in detail herein, it is to be understood that the inventive concepts may be otherwise variously embodied and employed, and that the appended claims are intended to be construed to include such variations, except as limited by the prior art.

What is claimed:

1. A self-defense tool comprising:

a grip portion having a central longitudinal axis; and a blade portion extending from the grip portion and forming a first angle between 40 and 50 degrees with respect to a line extending perpendicularly from the central longitudinal axis, wherein the blade portion comprises a blunt outer portion that curves to a tip and a blunt inner portion; and a sharpened portion positioned between the tip and the blunt inner portion, the sharpened portion extends in a straight line that forms a second angle with the line perpendicular to the central longitudinal axis, the second angle measuring between 40 and 50 degrees.

2. The self-defense tool according to claim 1, wherein the first angle is between 45 and 48 degrees, and wherein the second angle is between 42 and 45 degrees.

3. The self-defense tool according to claim 1, wherein the first and second angles are substantially complementary.

4. The self-defense tool according to claim 1, wherein the grip portion is substantially straight and capable of being used ambidextrously.

5. The self-defense tool according to claim 4, wherein the grip portion has four indents, wherein the fourth indent is positioned proximate to the sharpened portion.

6. The self-defense tool according to claim 1, wherein the blunt inner portion includes at least one indent.

7. The self-defense tool according to claim 6, wherein the at least one indent is smoothly curved in shape.

8. The self-defense tool according to claim 1, wherein the blade portion and the grip portion are detachable.

9. The self-defense tool according to claim 1, wherein the grip portion includes a pointed distal end.

10. The self-defense tool according to claim 9, wherein the pointed end has a pyramidal shape.

11. The self-defense tool according to claim 1, further comprising:

a holster that is shaped to accommodate the blade portion and at least partially cover the sharpened portion.

12. The self-defense tool according to claim 11, wherein the holster includes a clip that facilitates attachment to a belt, wherein the clip is configured to hold the self-defense tool so that the grip portion is in a substantially horizontal position.

13. The self-defense tool according to claim 11, wherein the holster includes a clip that facilitates attachment to a belt, wherein the clip is configured to hold the self-defense tool so that the grip portion is held at an angle of between 6 and 10 degrees relative to the clip.

14. The self-defense tool according to claim 1, wherein the blade portion has a height from the tip to an apex of the curved outer blunt portion that is between 50 mm and 90 mm, and the lateral distance between the tip and the grip portion is between 90 mm and 130 mm.

15. A self-defense tool comprising:

a grip portion having a central longitudinal axis; and a blade portion extending from the grip portion and forming a first angle between 40 and 50 degrees with respect to a line extending perpendicularly from the central longitudinal axis, wherein the blade portion comprises a blunt outer portion that curves to a tip and a blunt inner portion; and a sharpened portion positioned between the tip and the blunt inner portion, the sharpened portion extends in a straight line.

16. The self-defense tool according to claim 15, wherein the grip portion includes a pointed distal end.

17. The self-defense tool according to claim 15, wherein the blade portion has a height from the tip to an apex of the curved outer blunt portion that is between 50 mm and 90 mm, and the lateral distance between the tip and the grip portion is between 90 mm and 130 mm.

18. A self-defense tool comprising:

a grip portion having a central longitudinal axis; and a blade portion extending from the grip portion and forming a first angle with respect to a line extending perpendicularly from the central longitudinal axis, wherein the blade portion comprises a blunt outer portion that curves to a tip and a blunt inner portion; and a sharpened portion positioned between the tip and the blunt inner portion, the sharpened portion extends in a straight line that forms a second angle with the line perpendicular to the central longitudinal axis, the second angle measuring between 40 and 50 degrees.

19. The self-defense tool according to claim 18, wherein the grip portion includes a pointed distal end.

20. The self-defense tool according to claim 18, wherein the blade portion has a height from the tip to an apex of the curved outer blunt portion that is between 50 mm and 90 mm, and the lateral distance between the tip and the grip portion is between 90 mm and 130 mm.

* * * * *